US005743508A

United States Patent [19]

Fiveash

[11] Patent Number: 5,743,508

[45] Date of Patent: Apr. 28, 1998

[54] TREE STAND WITH UPWARD/EXTENDING SUPPORT MEMBERS FORMING PART OF A WATER BASIN

[76] Inventor: Ramon A. Fiveash, 5938 Woodway Place Ct., Houston, Tex. 77057

[21] Appl. No.: 595,831

[22] Filed: Feb. 2, 1996

[51] Int. Cl.[6] ..... A47G 35/12

[52] U.S. Cl. ..... 248/527; 47/40.5

[58] Field of Search ..... 248/519, 521, 248/516, 523, 527; 47/40.5

[56] References Cited

U.S. PATENT DOCUMENTS

| | | | |
|---|---|---|---|
| 1,091,000 | 3/1914 | Lyman | 47/40.5 |
| 1,110,142 | 9/1914 | Piner . | |
| 1,240,376 | 9/1917 | Saucier | 248/519 |
| 1,401,144 | 12/1921 | Dicks . | |
| 1,575,488 | 3/1926 | Jakobey . | |
| 1,644,807 | 10/1927 | Zeigler | 47/40.5 X |
| 2,605,067 | 7/1952 | Lindsell . | |
| 2,681,780 | 6/1954 | Santoro | 248/521 X |
| 2,905,414 | 9/1959 | Zierden | 248/519 X |
| 2,933,274 | 4/1960 | Mausolf . | |
| 3,026,075 | 3/1962 | Phelon et al. | 248/527 X |
| 3,051,423 | 4/1962 | Wagner et al. . | |
| 4,007,901 | 2/1977 | Mancini et al. | 47/40.5 X |
| 4,254,578 | 3/1981 | Hanfield . | |
| 4,496,129 | 1/1985 | Waterman et al. | 248/527 |
| 4,541,601 | 9/1985 | Corbisello | 248/516 |
| 4,571,881 | 2/1986 | Lathim . | |
| 4,834,335 | 5/1989 | Attar | 248/527 X |
| 4,884,363 | 12/1989 | Sofy . | |
| 4,913,395 | 4/1990 | Juhas | 248/516 |
| 4,989,820 | 2/1991 | Sterling | 248/523 |
| 5,121,897 | 6/1992 | Sofy | 248/527 |
| 5,320,323 | 6/1994 | Clark, Jr. | 248/523 |
| 5,484,131 | 1/1996 | Aldrete et al. | 248/527 |
| 5,551,659 | 9/1996 | Sofy | 248/523 |
| 5,580,026 | 12/1996 | Newcomer | 248/527 X |

FOREIGN PATENT DOCUMENTS

| | | | |
|---|---|---|---|
| 48512 | 12/1985 | Germany | 47/40.5 |

OTHER PUBLICATIONS

"Gunnard 4 Brace" tree stand, (two (2) photographs showing the stand assembled and disassembled).

*Primary Examiner*—Ramon O. Ramirez
*Assistant Examiner*—Stephen S. Wentsler
*Attorney, Agent, or Firm*—Rita M. Irani

[57] ABSTRACT

The present invention relates to a tree stand having a large water basin and a plurality of extending support sections for supporting a tree. The extending support sections form part of a sidewall of the water basin. The spacing of the extending support sections allows lower limbs of the tree to extend between the support sections and above lower sidewall sections of the water basin. This arrangement allows the stand to be secured closer to the center of gravity of the tree than conventional tree stands and allows a large breadth water basin design.

8 Claims, 3 Drawing Sheets

TREE STAND WITH UPWARD/EXTENDING SUPPORT MEMBERS FORMING PART OF A WATER BASIN

FIELD OF THE INVENTION

The present invention relates to stands for real and artificial trees, such as Christmas trees.

BACKGROUND OF THE INVENTION

Tree stands for cut trees typically include a water basin or reservoir for providing water essential for maintaining tree freshness and for preventing the cut tree from becoming a fire hazard. The basin is mounted above ground level by way of several legs. To support the tree against tipping, the base of the stand needs to be broad enough to provide stability when the tree is mounted within the water basin and the basin is full.

A typical six or seven foot fresh cut pine tree can consume as much as a gallon of water a day. For this reason, the basin preferably has a capacity of at least a gallon of water. As can be appreciated, the larger the diameter of the trunk at it's cut end, the larger the basin needs to be.

The water capacity of the basin can be increased by either increasing its depth or its diameter. However, typical tree stands rely on screw mounted posts extending inwardly from the basin side walls to provide lateral support for the tree within the basin. This limits the breadth of the basin, because, as can be appreciated, the closer the point of contact with the tree is to the basin sidewalls, the more effective will be the lateral support provided by the lateral posts. For this reason, to have a one gallon water capacity would require the basin to be deep.

As can be appreciated, the deeper the basin, the broader the base will need to be to provide the requisite lateral support for the tree and water basin combination. However, a deep and narrow basin has the additional disadvantage of making the open top of the basin, with the tree inserted, less accessible for checking the water level and replenishing the water supply.

In addition, to fit the tree into the basin, the lower branches must be removed throughout the entire depth of the basin. This requirement can leave unsightly gaps in the tree foliage at the base of the tree, and leave too much of the tree stand exposed to view beneath the foliage.

To provide a broader basin while still providing lateral support for the tree, U.S. Pat. No. 4,496,129 to Waterman provides a plurality of arms extending upwardly from the sidewalls of the basin for securing the tree above the top rim of the basin. Because the base of the securing arms are secured against the basin sidewalls, the Waterman design still relies on the basin sidewalls locally for lateral support of the tree. Thus, Waterman suffers from the stability problems inherent in any stand which supports the tree from basin sidewalls.

It would be advantageous to provide a tree stand which can include a broad and shallow basin which will accommodate a range of tree trunk diameters, has an accessible top for replenishing the water supply, and provides ample lateral support for the tree with the basin.

SUMMARY OF THE INVENTION

The present invention relates to a new and improved tree stand for supporting and supplying water to a tree, such as a Christmas tree. A generally cylindrical water basin is mounted within a conically shaped outer wall. The outer wall has a plurality of upward outer wall extensions that are used to contact the outer surface of a tree that is placed within the water basin. The distal ends of the outer wall extensions include bolts for securing the trunk of the tree within the water basin. The spacing of the outer wall extensions allows lower limbs of the tree to extend between the outer wall extensions and above the rest of the outer wall. Thus, the bolts contact the tree closer to the tree's center of gravity than conventional stands which mimimizes tipping of the tree.

A plurality of upward extensions from the basin sidewalls meet the outer wall extensions. Thus, the diameter of the basin can be substantially greater than the diameter of the trunk of the tree. This feature facilitates watering of the tree and monitoring of the water level of the basin.

A ball-and-socket joint facilitates positioning of the tree in the stand. The basin includes a socket which receives a ball element mounted to the bottom of the tree through spikes or nails. Thus, the tree can be correctly positioned in the stand before the bolts are tightened.

BRIEF DESCRIPTION OF THE DRAWING

A better understanding of the present invention can be obtained when the following detailed description of a preferred embodiment is considered in conjunction with the drawing in which.

DETAILED DESCRIPTION OF PREFERRED EMBODIMENTS

Figure 1:
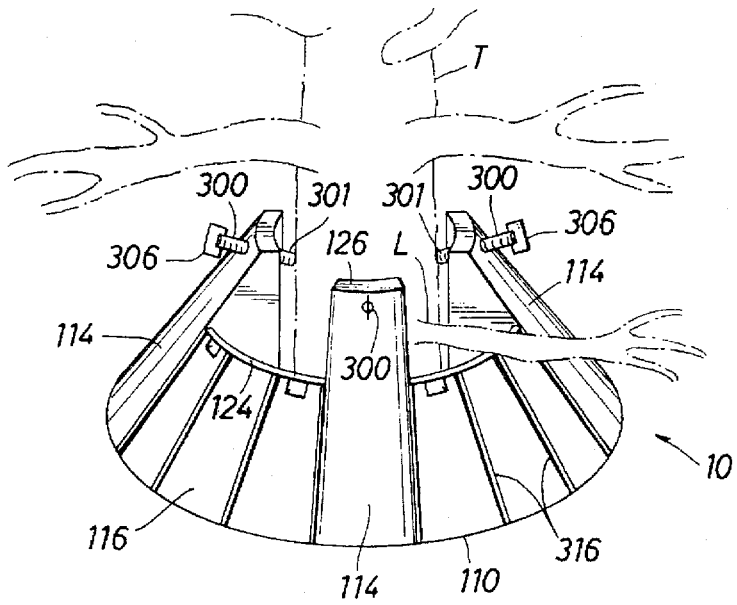
FIG. 1 is a perspective view of a preferred embodiment of the present invention.

A preferred embodiment of the invention is shown in FIGS. 1 through 4. With reference to FIG. 1, the tree stand 10 of the present invention is generally cone shaped having an outer circular rim 110 and upwardly, inwardly sloping sidewalls 116. Within the sidewalls 116 are sidewall extensions 114 which function to secure a tree trunk T within the stand 10, as more particularly shown in FIGS. 2 and 3, discussed below.

Figure 3:
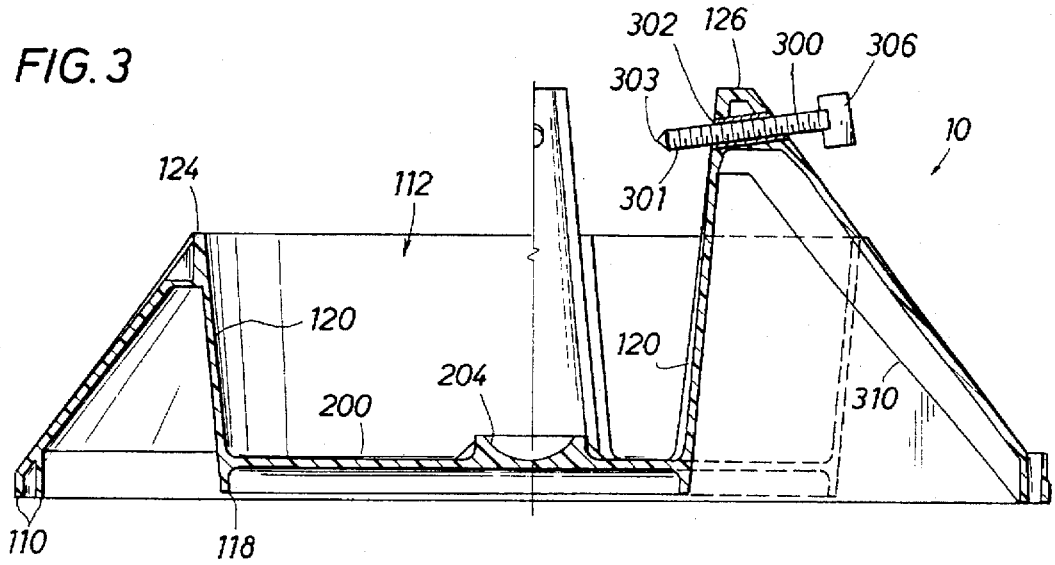
FIG. 3 is a side cross-sectional view taken along line 3—3 of FIG. 2.

The stand 10 includes a water basin 112 mounted within the inwardly sloping sidewalls 116. The water basin 112 is formed from a bottom wall 200 which is integral with upstanding basin sidewalls 120. With reference to FIG. 3, the underlying surface of the bottom wall 200 has an inner rim 118. The bottom wall 200 and the inner rim 118 are preferably slightly elevated relative to the floor. This is accomplished through strengthening ribs 310 which secure the inwardly sloping sidewalls 116 to the basin sidewalls 120. Thus, the outer rim 110 supports the weight of the stand 10. It has been found that an outer rim 110 having a diameter of twenty inches is suitable for supporting a six foot to eight foot tree. In a preferred embodiment, the diameter of the outer rim 110 is approximately twenty inches.

It has been found that elevating the bottom wall 200 relative to the floor minimizes the chance that condensation due to the difference between air temperature and the temperature of water in the basin will cause the underlying floor or carpet to become moist. An elevation of one-half to one inch is adequate for this purpose. As can be appreciated, distributing the weight of the stand 10 around the large outer rim 110 increases the stability of the stand 10.

Turning now to the tree securing structure of the stand 10, in the illustrated embodiment, the sidewall extensions 114 provide spaced side supports having at their upper end a means for securing the tree trunk T within the basin 112, spaced from the basin sidewalls 120. Bolts or screws 300 threaded for engagement with correspondingly threaded holes or threaded inserts 302 in the upper end of the stand sidewall extensions 114 provide a convenient securing means.

To more firmly secure the bolts 300 to the surface of the tree, caps 301 are inserted over the terminal ends of the bolts 300. The terminal ends 303 of the caps 301 are pointed to penetrate the bark of the tree; however, the caps 301 effectively increase the cross-sectional area of the bolts 300. This increased cross-sectional area minimizes the penetration of the caps 301 through the bark and into the wood of the tree. Thumb screws or wings 306 are preferably provided on the outside end of the bolts 300 for ease in tightening the bolt ends against the tree trunk T. To provide some downward tension, its is advantageous to slant the threaded inserts 302 toward the bottom of the basin 112, as best shown in FIG. 3.

Although the illustrated embodiment includes four equally spaced supporting extensions and associated bolts, as can be appreciated, the number of extensions and bolts can be as few or as many as reasonable for the size of the stand taking into account manufacturing costs and the need to provide adequate space between extensions for access to the water basin.

As best shown in FIG. 3, for increased structural rigidity, the basin sidewalls 120 preferably extend upward to meet the top of the sidewall extensions 116, where they are joined to provide the threaded bolt holes or clearance holes for threaded inserts 302. Between the sidewall extensions 116, the basin sidewalls 120 are lower to provide space for easy access to the basin 112 for checking and replenishing the water level in the basin 112. By providing the extended sidewalls, the tree trunk T can be fastened close to its center of mass yet well up the trunk T to provide increased stability against tipping. In addition, the spacing between the extensions 116 minimizes or eliminates the need to remove lower branches L which extend outwardly above a lower rim 124 of the basin sidewall 112 and below an upper rim or top level 126 of the stand 10. The spacing can also accommodate a trunk T cross-section that deviates from a true circular shape.

It is a further feature of the invention to shape an inner surface 106 of the basin sidewalls 120 where the sidewalls 120 extend upwardly to meet the sidewall extensions 116. The inner surfaces 106 provide more flexibility for maneuvering the tree trunk T to fit within the basin 112. In other words, the inner surfaces 106 of the basin sidewall extensions 114 are curved. In a twenty inch diameter stand having four equally spaced extensions 114, these inner surfaces 106 each can form a two inch arc. This allows the trunk T to be rotated so that irregular cross sections or bumps on the trunk T fit within the spaces or the deepest part of the inner surfaces 106.

Injection molded plastic is an ideal material for the present invention. Due to the weight of a typical tree, a high impact plastic such as polyethylene or polypropylene is preferred. The plastic material (1) enables the stand 10 to be formed as a one piece construction, (2) provides a rustproof structure, and (3) provides sufficient resilience to enhance distribution of uneven loads caused by unbalanced trees.

Figure 4:
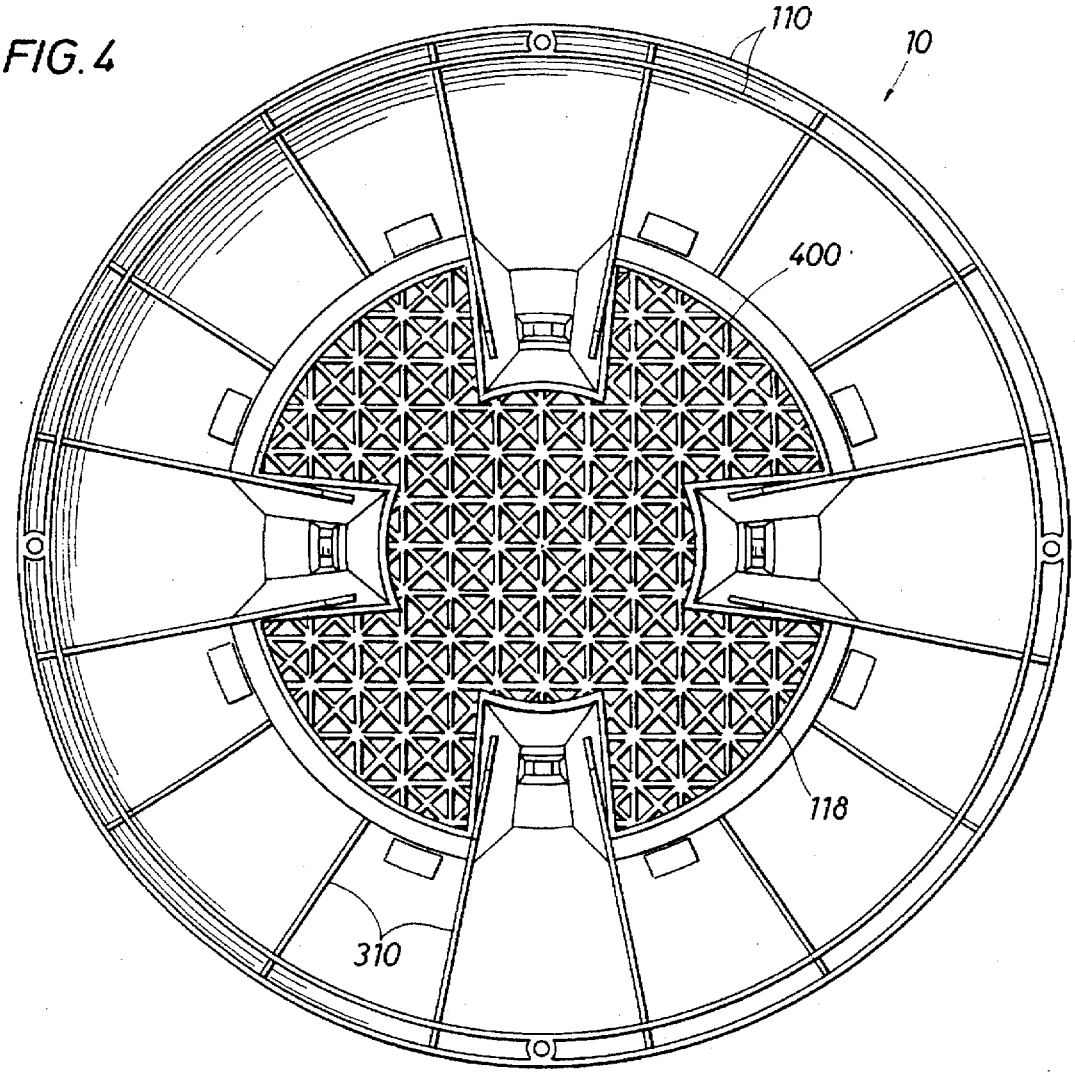
FIG. 4 is a plan view of the underside of the illustrated embodiment.
Figure 2:
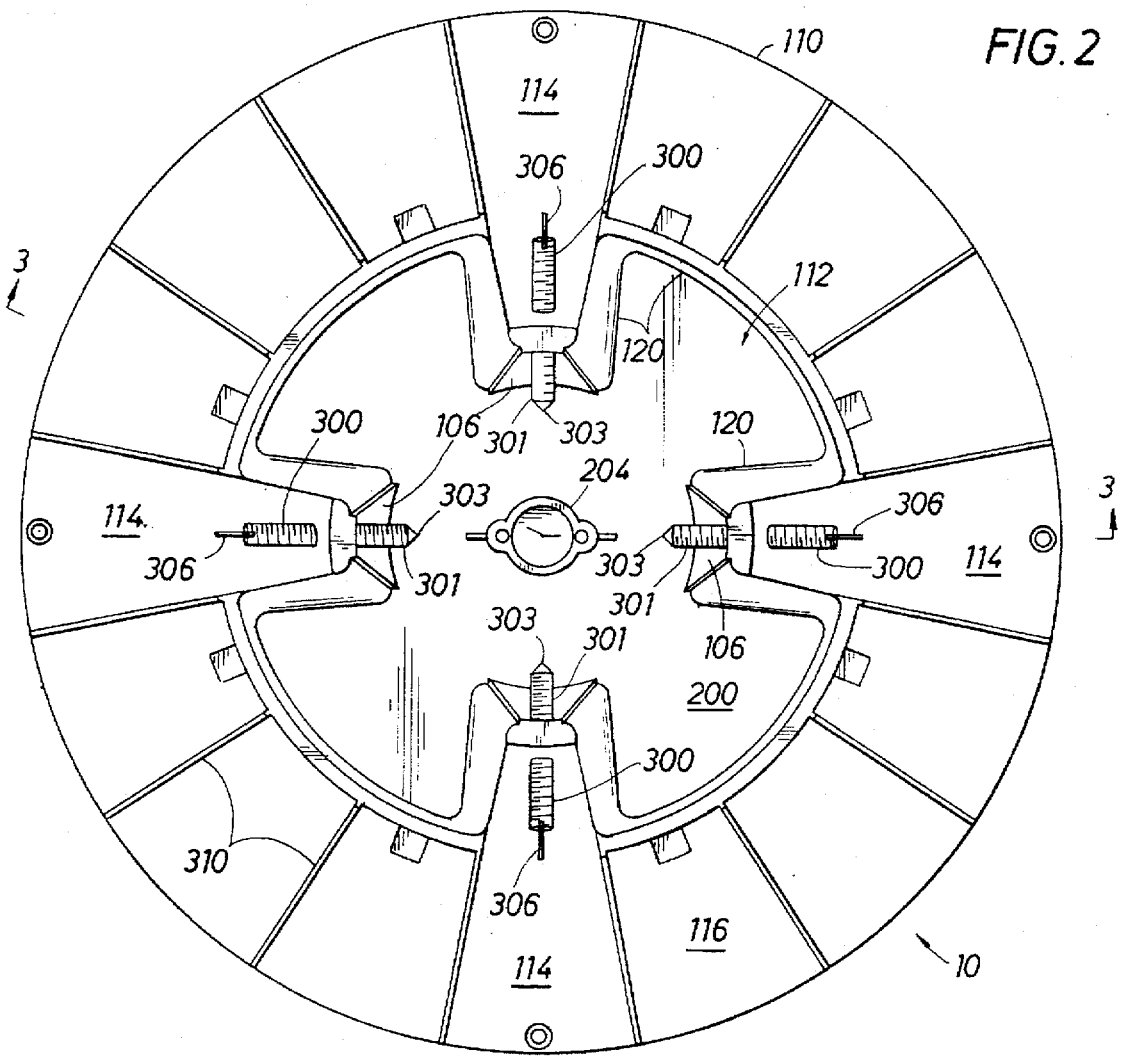
FIG. 2 is a top plan view of the illustrated embodiment of the present invention.

As best shown in the bottom or underside view of FIG. 4, when this material is used, the bottom wall 200 of the basin can be formed in a honeycomb pattern 400 for increased strength and rigidity to withstand the weight of the tree T. The outer rim 110 can be formed with a channel to decrease the amount of plastic material and still provide adequate strength.

Figure 5:
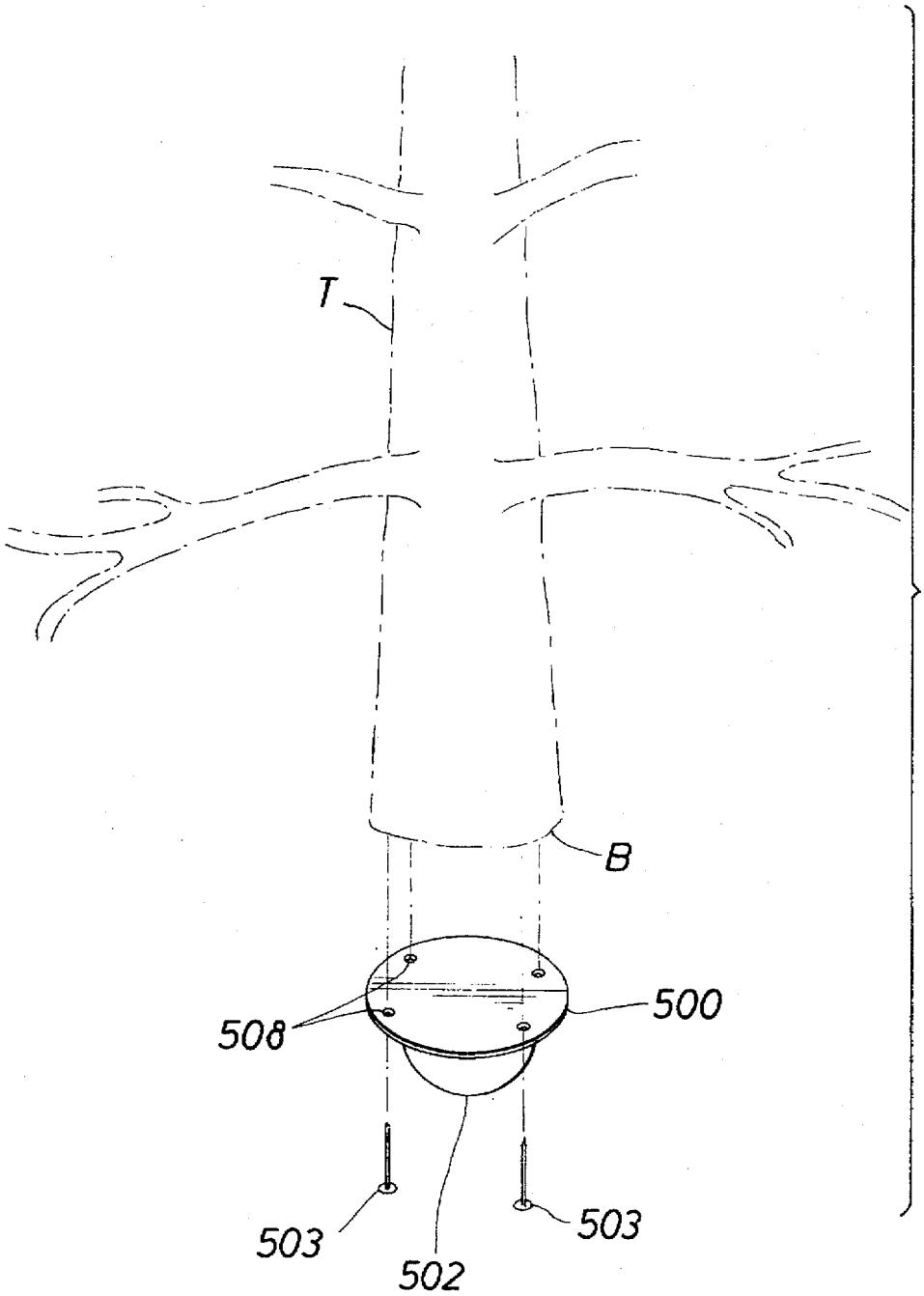
FIG. 5 is an exploded side view showing the ball-and-socket feature of the present invention.

As illustrated in FIG. 5, the tree stand 10 can advantageously include a means for permitting the tree to be rocked sideways before being secured to the tree stand 10 to balance the tree within the stand 10. As illustrated, the rocking means can include a base plate 500 having secured thereon a hemisphere 502 and provided with means for securing the base to the cut end of the tree T to be supported by the tree stand 10. This means could be nails or spikes 503 driven into the cut end through holes 508 in the base 500. A corresponding indentation, or socket, 204 can be provided in the water basin bottom wall 200 for receiving the hemisphere 502.

With this arrangement, when the cut end of the tree is placed within the water basin 112, it can be easily centered as the hemisphere 502 falls into the indentation 204, and then the tilt of the tree T can be adjusted as needed to put the tree in its most stable equilibrium position before securing the bolts 300 in place against the tree trunk.

In order to mount the tree to the tree stand 10, the base plate 500 is first attached to the cut bottom of the tree through nails 503 which are extended through the holes 508. The bolts 300 are then unscrewed outwardly to allow the tree to fit inside the stand 10. The tree is then pivotally mounted to the tree stand 10 by placing any lower limbs L of the tree between the sidewall extensions 116, if necessary, and by placing the base plate 500 inside the indentation 204. The tree can then be positioned in a stable vertically upright position by pivoting the tree and tightening the bolts 300 accordingly. The water basin 112 can then be filled with water.

The foregoing disclosure and description of the invention are illustrative and explanatory thereof, and various changes in the size, shape and materials, as well as the details of the illustrated operation and construction may be made without departing from the spirit and scope of the invention.

What is claimed is:

1. A tree stand comprising:

an outer container including a base wall and sidewalls joined to the base wall wherein said sidewalls inwardly slope away from the base wall to define a container opening;

a plurality of spaced, tree support members having inner surfaces, said members being secured to the base wall in a substantially upright position and having a length greater than a height of the outer container wherein the inner surfaces of the tree support members define a tree trunk opening such that the members define a space available within the container for the base of a tree trunk and wherein the tree support members in combination with inner surfaces of the sidewalls define a water basin; and wherein each tree support member includes an elongated, radially oriented channel extending through the member adjacent its distal end for containing a securing arm.

2. The tree stand of claim 1 wherein the elongated channel is oriented at a downwardly sloping angle toward the center of the container.

3. The tree stand of claim 1 further comprising a securing arm sized to fit within the elongated channel and extendable inwardly from the tree support member for contact with the tree trunk.

4. The tree stand of claim 3 wherein the channel includes a threaded inner surface and the securing arm includes a correspondingly threaded bolt.

5. The tree stand of claim 1 wherein each tree support member has a concave inner surface.

6. The tree stand of claim 1 wherein the tree support members are joined to both the container base wall and the container sidewalls.

7. The tree stand of claim 1 further comprising an indentation at the center of an inner surface of the base for receiving a ball affixed to the cut surface of the tree trunk.

8. A tree stand comprising:

an outer container including a base having sidewalls joined to the base wherein said sidewalls inwardly slope away from the base to define a container opening; and a plurality of spaced, substantially rigid tree support members secured to the base and extending upwardly therefrom to terminate a distance beyond the container opening to define a tree trunk opening such that the spaced tree support members define a space available within the container for the base of a tree trunk and wherein the tree support members in combination with inner surfaces of the sidewalls define a space available for containing fluid for a cut tree.

* * * * *